US009975672B2

(12) United States Patent
Crull

(10) Patent No.: US 9,975,672 B2
(45) Date of Patent: May 22, 2018

(54) LATCH MECHANISM FOR FRONT OPENING LID

(71) Applicant: Snap-on Incorporated, Kenosha, WI (US)

(72) Inventor: Jeffrey L. Crull, McFarland, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days. days.

(21) Appl. No.: 14/924,171

(22) Filed: Oct. 27, 2015

(65) Prior Publication Data

US 2016/0046418 A1 Feb. 18, 2016

Related U.S. Application Data

(62) Division of application No. 13/163,161, filed on Jun. 17, 2011, now Pat. No. 9,199,370.

(51) Int. Cl.

| | |
|---|---|
| ***E05B 65/02*** | (2006.01) |
| ***B65D 45/16*** | (2006.01) |
| ***B25H 3/02*** | (2006.01) |
| ***E05B 65/52*** | (2006.01) |
| ***E05C 3/04*** | (2006.01) |
| ***B65D 25/28*** | (2006.01) |
| ***B65D 43/02*** | (2006.01) |
| *E05B 17/20* | (2006.01) |

(52) U.S. Cl.

CPC ..... *B65D 45/16* (2013.01); *B25H 3/02* (2013.01); *B65D 25/28* (2013.01); *B65D 43/02* (2013.01); *E05B 65/5276* (2013.01); *E05C 3/048* (2013.01); *B65D 2525/283* (2013.01); *B65D 2525/287* (2013.01); *E05B 17/2057* (2013.01)

(58) Field of Classification Search

CPC ..... B65D 45/16; B25H 3/02; E05B 65/52; E05B 65/5276; A45C 13/1084

See application file for complete search history.

(56) References Cited

U.S. PATENT DOCUMENTS

| | | | | |
|---|---|---|---|---|
| 3,244,830 | A | 4/1966 | Bates | |
| 5,111,918 | A * | 5/1992 | Bako | A45C 5/14 190/115 |
| 5,924,533 | A | 7/1999 | Cnockaert et al. | |
| 2001/0011620 | A1 | 8/2001 | Tiramani et al. | |
| 2008/0116696 | A1 | 5/2008 | Schmitt et al. | |
| 2010/0084447 | A1 | 4/2010 | Elliott et al. | |
| 2011/0067462 | A1 * | 3/2011 | Tonelli | A45C 13/1084 70/73 |

OTHER PUBLICATIONS

Australian Government Patent Examination Report No. 1, dated Jun. 9, 2016; 4 pages.

(Continued)

*Primary Examiner* — Andrew T Kirsch

(74) *Attorney, Agent, or Firm* — Seyfarth Shaw LLP

(57) ABSTRACT

A latch with a handle that is elastically biased in the closed position. The latch is attached to the lid via a handle, and when the handle is disengaged from the lid, the latch can be rotated away from the lid. Upon rotating the latch away from the lid, hooks on the latch will disengage with a receiving portion of a case, thereby allowing the lid to be removed from the case.

6 Claims, 3 Drawing Sheets

(56) References Cited

OTHER PUBLICATIONS

UK Intellectual Property Office Examination Report, dated May 26, 2017; 6 pages.
UK Office Action for Application No. GB1322787.1, dated Nov. 9, 2017, 3 pages.
UK Examination Report for Application No. GB1322787.1, dated Feb. 9, 2018, 3 pages.
UK Combined Search and Examination Report for Application No. GB1802873.8, dated Mar. 13, 2018, 5 pages.

* cited by examiner

LATCH MECHANISM FOR FRONT OPENING LID

CROSS-REFERENCE TO RELATED APPLICATIONS

The present application is a divisional of U.S. application Ser. No. 13/163,161, filed Jun. 17, 2011, the contents of each which are herein incorporated by reference.

FIELD OF THE INVENTION

The present invention relates to a latch for a front opening lid. In particular, the present invention relates to a latch having an elastically-biased handle that disengages from a locked position and rotates away from the lid to an unlocked position.

BACKGROUND OF THE INVENTION

Latch mechanisms are a well-known structure for securing two objects together, for example, a lid on a case. A standard latch mechanism requires a tool to be opened, or includes a space-consuming structure with a large footprint.

For industrial cases or toolboxes, front lid latches are typically provided on the lower portion of the lid to latch the lid to the case. The conventional latch will have a low ground clearance, and the user may scrape his or her hand against the ground trying to open the latch. Also, users of this type of case commonly wear gloves, and the low clearance or tight quarters of the conventional latch make it difficult for a user to open the latch if the user is wearing gloves.

Some conventional latches include a handle that is elastically biased into the closed position to maintain a locked latch unless a user applies an external force to the handle. The conventional elastically-biased latches include hooks or other engaging means on the handles, and when lifting the handle, the user also lifts up on the engaging structure. However, such a structure must be manufactured with a high degree of precision in order to align the engaging structure and the handle. Further, the engaging structure itself is elastically biased in the conventional latch structure, and is constantly subjected to stress based on the elastic bias.

SUMMARY OF THE INVENTION

The present application discloses a latch structure, and a method thereof, that includes sufficient ground clearance and allows a user with gloves to easily unlock the latch. In addition, the present application discloses a latch structure for connecting a lid and a case together, and where the attachment member of the lid is not itself elastically biased against the case. In particular, the present application discloses a latch for coupling a lid to a case, the latch including a main body including a hook, a handle coupled to the main body and including a retaining member, and a pin adapted to be coupled to the lid and further adapted to receive the retaining member, the handle being biased to a latched position to engage the retaining member against the pin, wherein the hook is adapted to cooperatively engage a receiving portion of the case to releasably couple the lid to the case when the handle is disposed in the latched position.

Also disclosed is a case assembly, including a case including a receiving portion, a lid removably coupled to the case by a latch, the latch including a main body including a hook, the hook being adapted to engage with the receiving portion of the case, a handle coupled to the main body and including a retaining member, and a pin coupled to the lid and adapted to receive the retaining member, the handle being elastically biased to engage the retaining member against the pin.

A method of removing a lid from a case, wherein the lid includes a latch coupled thereto, is also disclosed and includes moving a handle of the latch axially upward against the bias of a bias member, disengaging a retaining member from a pin based on the step of moving the handle axially upward, rotating the latch away from the lid, and rotating the lid away from the case.

BRIEF DESCRIPTION OF THE DRAWINGS

For the purpose of facilitating an understanding the subject matter sought to be protected, it is illustrated in the accompanying drawing embodiments thereof, from an inspection of which, when considered in connection with the following description, the subject matter sought to be protected, its construction and operation and many of its advantages should be readily understood and appreciated.

DETAILED DESCRIPTION OF PREFERRED EMBODIMENTS

Figure 1:
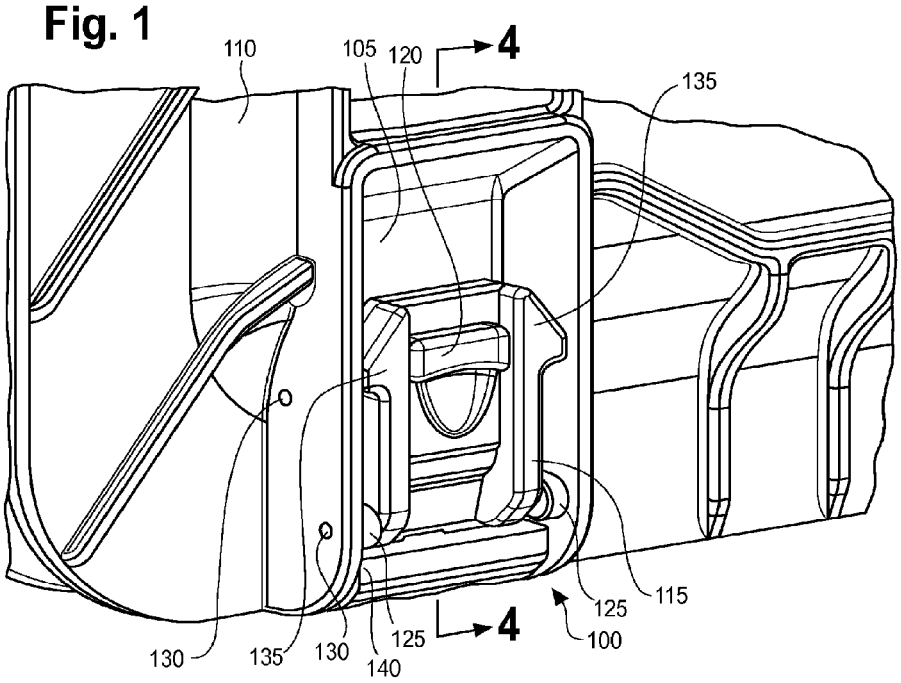
FIG. 1 is an enlarged, perspective view of an embodiment of the latch of the present application disposed in the latched position.

While the present invention is susceptible of embodiments in many different forms, there is shown in the drawings and will herein be described in detail an embodiment of the invention with the understanding that the present disclosure is to be considered as an exemplification of the principles of the invention and is not intended to limit the broad aspect of the invention to the embodiments illustrated.

The present application discloses an apparatus and a method for latching together two objects, for example, a lid and a case. The latch provides sufficient ground clearance and allows a user wearing gloves to easily unlock the latch. In addition, the latch can provide an attachment portion on the lid that is not itself elastically-biased, and thus reduces the amount of wear on the latch and the need for a high degree of precision when manufacturing the latch.

Figure 2:
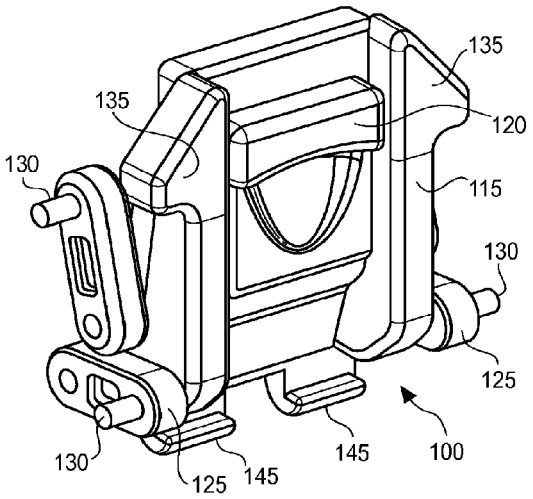
FIG. 2 is a front perspective view of a latch of FIG. 1, shown separated from the lid and case.
Figure 3:
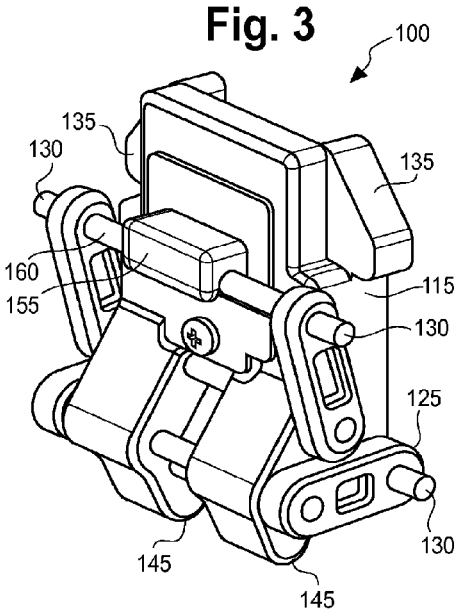
FIG. 3 is a rear perspective view of the latch embodiment of FIG. 1, shown separated from the lid and case.

Referring to FIG. 1, a latch 100 is shown disposed within a recessed area 105 on a lid 110. The latch 100 includes a main body 115 and a handle 120 that is slidably coupled to the main body 115. Pivot points 125 are provided inside the recessed area 105 to allow the latch 100 to rotate away from the lid 110. The pivot points 125, and other connecting points of the latch 100 are attached to the lid 110 by way of pins 130. In addition, the latch 100 can include one or more elbows 135 that can allow the latch 100 to friction fit into the recessed area 105 when positioned therein or that allow the user to better grip the handle 120. The latch 100 couples the lid 110 to another object, such as a toolbox or a case, by connecting the latch 100 to a receiving portion 140 on the toolbox, case, or other structure. For example, as shown in FIG. 2, the latch 100 may include hooks 145 that engage the receiving portioned 140 when positioned therein.

The recessed area 105 can be provided on the lid 110 and may allow the latch 100 to be positioned therein. As shown in an embodiment, the recessed area 105 is rectangular and includes sufficient clearance above the latch 100 to allow a user wearing, for example, working gloves to reach into the recess area 105 and open the latch 100. However, any shape of recessed area 105 can be implemented within the spirit and scope of the present application. Further, although it is preferable to include a large clearance so that a user can reach into the recessed area 105 with fingers to better grasp the latch, it will be appreciated that space concerns may limit this structure. Thus, recess area 105 need not have a large clearance, and may further include a small clearance to make the design more compact.

The lid 110 is adapted to substantially cover an opening of a box, a case, or any other structure. As shown, lid 110 may be pivotally coupled to the box, but lid 110 can also slide away from the box, or can be removed from the box without rotation, or by any other manner of removing a lid from a box.

The latch 100 includes a main body 115 having elbows 135 that allow the latch 100 to frictionally engage the recess area 105, in certain embodiments, or to provide a larger gripping area for the user. Also, main body 115 includes hooks 145 that engage receiving portion 140. Hooks 145 may be integral with or attached to the main body 115.

Handle 120 is shown as being positioned within a center portion of the main body 115, and includes a grip that allows a user to pull upwardly on the handle 120 and release the lock of the handle 120. However, it will be appreciated that handle 120 may include a structure that allows downward movement so as to release the lock, or need not include any structure that receives a hand of a user. Further, handle 120 need not be placed in the direct center of the main body 115, but can be positioned off center, or at a side of the main body 115. As will be discussed below with reference to FIG. 4, in an embodiment, handle 120 is elastically biased in a downward direction (relative to latch 100 position in FIG. 2) such that general upward movement of handle 120 is elastically resisted.

As shown in FIG. 2, latch 100 includes one or more pivot points 125 that allow latch 100 to pivot about a central point and rotate away from lid 110. As such, pivot points 125 are located at the bottom of latch 100, but it will be appreciated that pivot points 125 may be located anywhere so as to allow latch 100 to rotate away from lid 110. Further, pivot points 125 may be located on a top of latch 100, so as to allow latch 100 to rotate away from lid 110 in a direction opposite of that shown in the figures. Pivot points 125 are connected to the main body 115 by pins 130. However, pivot points 125 may be connected by other attachment means, for example, adhesive. Further, latch 100 need not include any pivot points 125, and can be attached directly to lid 110 by way of pins 130.

The receiving portion 140 is generally located on the box structure and is adapted to receive lid 110 by way of latch 100. For example, receiving portion 140 may be located on a case, a toolbox, a tackle box, or any other enclosed structure that requires or can benefit from a latch structure to secure a lid thereto. As shown, receiving portion 140 is adapted to receive hooks 145 at two portions thereof. Hooks 145 can be integral with or attached to the main body 115 of latch 100. The latch 100 can include any number of hooks 145 without departing from the spirit and scope of the present application. Further, receiving portion 140 need not be a hook engagement structure as shown, but may be any other structure capable of receiving a complimentary component of latch 100.

Figure 4:
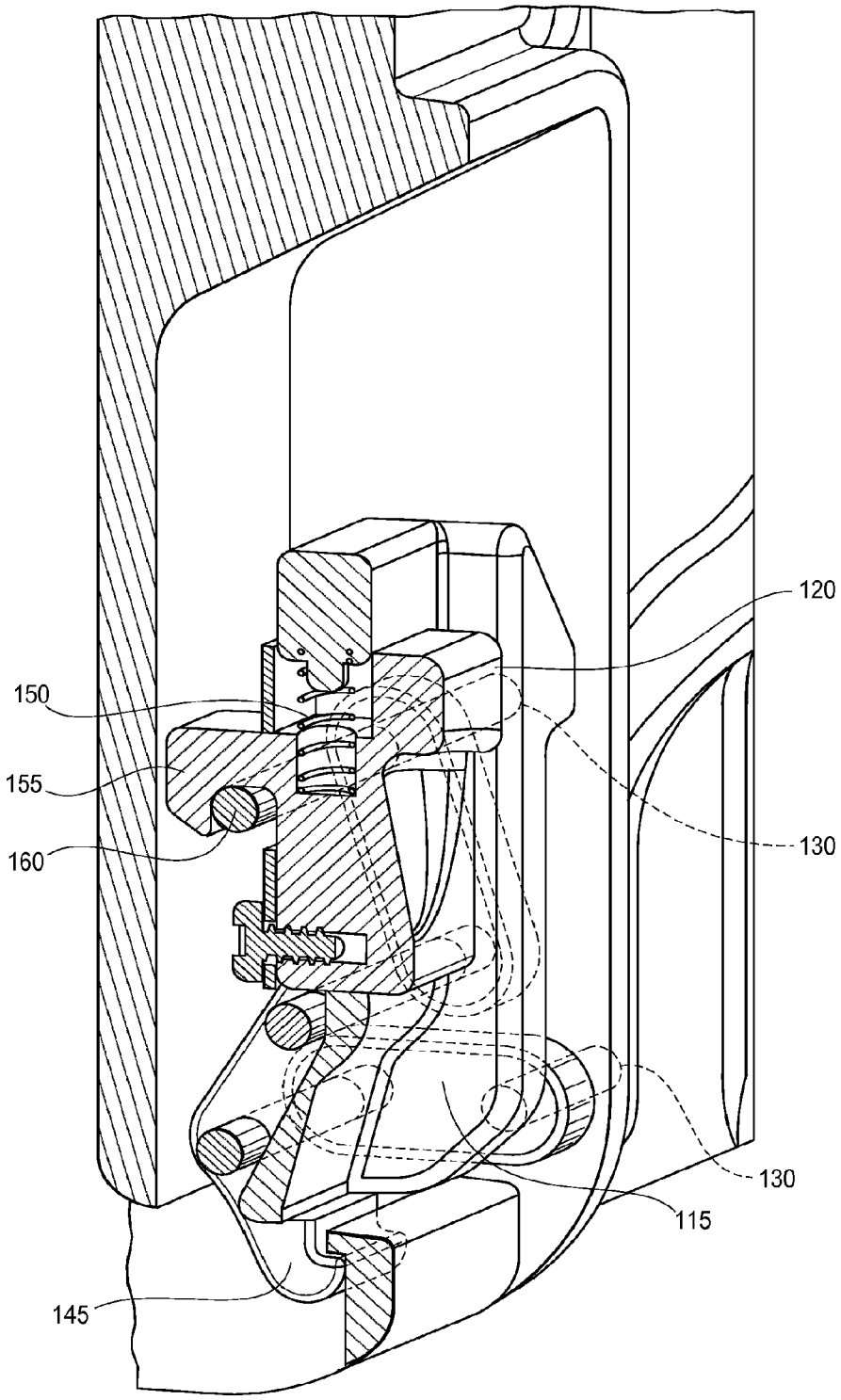
FIG. 4 is a cross-sectional view of the latch, taken along line 4-4 of FIG. 1.

FIG. 4 is a sectional view of latch 100 in accordance with an embodiment of the present application. As shown, and as previously discussed, latch 100 includes a handle 120 that is elastically-biased in a latched position. As shown in FIG. 4, a bias member 150 provides elastic bias to the handle 120 when the handle 120 is moved in a general upward direction, and by providing the elastic bias, the bias member 150 pushes the handle 120 in a downward direction and into the latched position. In particular, the latch 120 includes a retaining member 155 that engages a dowel pin 160 when pushed in the downward direction, so as to lock latch 100 against lid 110. To unlock the latch 100 and rotate the latch away from the lid 110, the user can lift upwardly on the handle 120 against the bias of the bias member 150 and remove the retaining member 155 from the dowel pin 160. Thereafter, the user can rotate the latch outward from the lid 110.

In an embodiment, bias member 150 may be a spring as shown in FIG. 4. However, any bias member 150 can be used in accordance with the present application. For example, the bias member 150 can be a hydraulic bias member, an elastomeric bias member or any other structure that is capable of applying an elastic force and pushing the retaining member of 155 into the locked position against the dowel pin 160.

As shown, the retaining member 155 is a hook adapted to cooperatively engage a corresponding structure of the dowel pin 160. However, any engaging structure can be used to connect the latch 100 to the lid 110 without departing from the spirit and scope of the present application. For example, the retaining member 155 can be a ring that engages a vertically extending dowel pin 160, or can include any other structure for maintaining the latch 100 against the lid 110.

A process of opening a lid 110 from a case will now be discussed. To disengage the handle 120 from the dowel pin 160, the user can lift upwardly on the handle 120 and overcome the elastic bias of the bias member 150, thereby moving the latch into an unlatched position. Upon moving the handle 120 upwardly, the retaining member 155 disengages from the dowel pin 160 and the latch 100 can be freely rotated away from the lid 110, using the pivot points 125 as a rotating axis. Once the latch 100 rotates away from the lid 100, the hooks 145 rotate inwardly toward the case, and disengage the receiving portion 140 to allow the lid 110 to be removed from the case. In an embodiment, it is not until the latch 100 is rotated substantially away from the lid 110 that the lid 110 can be removed from the case. Prior to this step, hooks 145 are engaged in the receiving portion 140, and thus the lid 110 is attached to the case.

The hooks 145 can rotate inwardly toward the case, rather than rotating outward away from the case and further expanding the footprint of the latch 100. The above structure and method thus allows for a more compact system while still providing the necessary function of joining together the lid 110 and case. In addition, it should be noted that the latch 100 does not disengage the lid 110 from the case by lifting upwardly of the handle 120. In an embodiment, the handle 120 does not itself include hooks 145, but rather hooks 145 are attached to the main body 115. Thus, lifting upwardly on the handle 120 and overcoming the bias of the bias member

Figure 5:
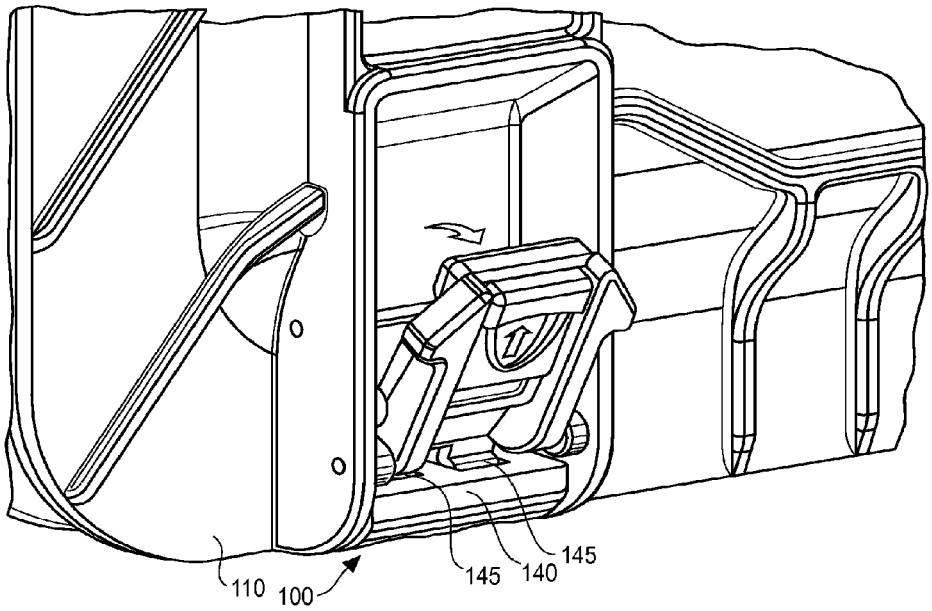
FIG. 5 is an enlarged perspective view of the latch after the handle is detached from dowel pin and disposed in an unlatched position, but prior to the lid being removed from the case shown in FIG. 1.
Figure 6:
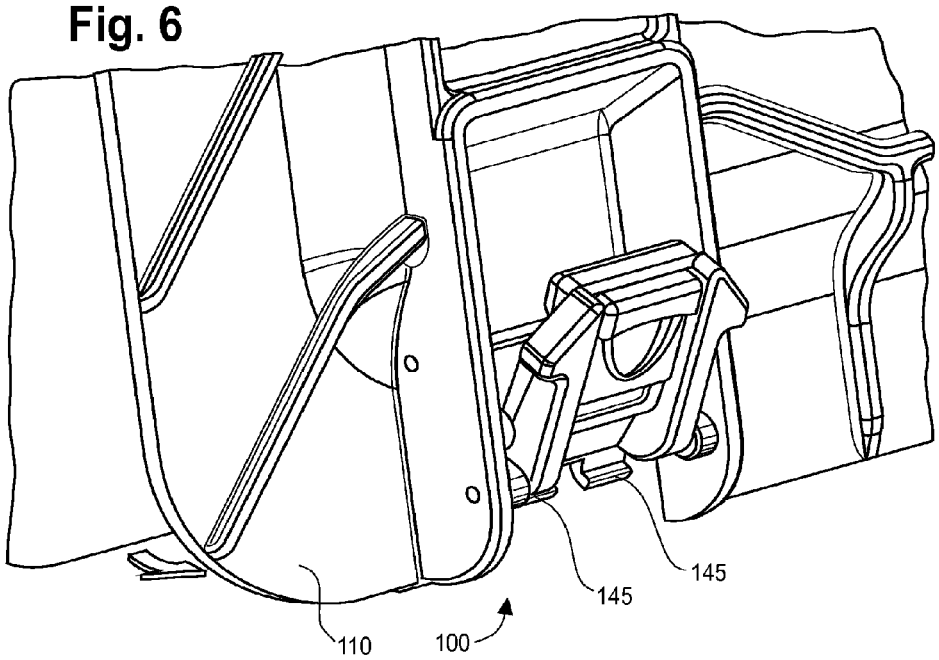
FIG. 6 is an enlarged perspective view of the latch of FIG. 1 disposed in an unlatched position and further illustrates the lid being pivoted away from the case.

150 will not itself disengage the hooks 145. However, a user can disengage the retaining member 155 from the dowel pin 160 by lifting upward on the handle 120, and only thereafter does the user rotate the latch 100 away from the lid 110 so as to disengage the hooks 145 from the receiving portion 140. The user can then pull on the lid 110 or the latch 100 in order to remove the lid 110 from the case. As shown in FIG. 5, the latch 100 can be rotated away from the lid 110, and as shown in FIG. 6, the lid 110 can be rotated away from the case.

In an embodiment, the main body 110 and the handle 120 are made of plastic. However, the materials of the main body 115, the handle 120, and other components of the latch 100 can be any form of plastic, metal, or any other material that allows the latch 100 to function as discussed above.

The matter is set forth in the foregoing description and accompanying drawings and examples is offered by way of illustration only and not as a limitation. More particular embodiments have been shown and described, and it will be apparent to those skilled in the art that changes and modifications may be made without departing from the broader aspects of applicant's contribution. The actual scope with the protection sought is intended to be defined in the following claims when viewed in their proper perspective based on the prior art.

What is claimed is:

1. A case assembly, comprising:

a case including a receiving portion;

a lid removably coupled to the case by a latch, the latch including:

a pin coupled to the lid;

a main body including a hook extending in a first direction outwardly away from an interior of the case; and a handle movable relative to the pin, the handle is coupled to the main body and includes a retaining member extending from a portion of the handle in a second direction that is opposite the first direction, the retaining member removably engages and disengages the pin upon selective movement of the handle, wherein the handle is biased towards the pin with a bias member such that the retaining member removably engages the pin with a bias, and disengages the pin against the bias, and wherein the hook engages with the receiving portion to releasably couple the lid to the case when the retaining member is engaged with the pin.

2. The case assembly of claim 1, wherein the handle is slidably disposed on the main body.

3. The case assembly of claim 1, further comprising a pivot point, wherein the main body is pivotably disposed on the lid at the pivot point to allow pivoting of the main body in an outwardly direction away from the lid.

4. The case assembly of claim 3, wherein pivoting of the main body in the outwardly direction rotates the hook inwardly away from the receiving portion and towards the case.

5. The case assembly of claim 1, wherein the main body includes an elbow adapted to frictionally engage with a recessed area disposed on the lid to form a friction fit between the main body and the recessed area.

6. The case assembly of claim 1, wherein the bias member is a spring.

* * * * *